US011927190B2

(12) United States Patent
Tontsch

(10) Patent No.: US 11,927,190 B2
(45) Date of Patent: Mar. 12, 2024

(54) VACUUM PUMP

(71) Applicant: Schwäbische Hüttenwerke Automotive GmbH, Aalen-Wasseralfingen (DE)

(72) Inventor: Thomas Tontsch, Bad Schussenried (DE)

(73) Assignee: Schwäbische Hüttenwerke Automotive GmbH (DE)

( * ) Notice: Subject to any disclaimer, the term of this patent is extended or adjusted under 35 U.S.C. 154(b) by 0 days.

(21) Appl. No.: 17/229,027

(22) Filed: Apr. 13, 2021

(65) Prior Publication Data

US 2021/0332820 A1 Oct. 28, 2021

(30) Foreign Application Priority Data

Apr. 24, 2020 (DE) ..... 10 2020 111 301.3

(51) Int. Cl.
*F04C 25/02* (2006.01)
*F04C 18/344* (2006.01)
*F04C 29/12* (2006.01)

(52) U.S. Cl.
CPC ..... *F04C 25/02* (2013.01); *F04C 18/3441* (2013.01); *F04C 29/126* (2013.01); (Continued)

(58) Field of Classification Search
CPC .... F04C 2220/10; F04C 25/02; F04C 29/124; F04C 29/126; F04C 29/128; F04C 28/24; (Continued)

(56) References Cited

U.S. PATENT DOCUMENTS

2010/0000207 A1* 1/2010 Heaps ..... F04C 2/344 60/397
2010/0239440 A1* 9/2010 Heaps ..... F04C 29/126 417/364

(Continued)

FOREIGN PATENT DOCUMENTS

DE 102010055125 A1 6/2012
DE 102016122903 A1 5/2018

(Continued)

OTHER PUBLICATIONS

German Search Report issued in German Application No. 10 2020 111 301.3, dated Feb. 22, 2021, 7 pages.

(Continued)

*Primary Examiner* — Mark A Laurenzi
*Assistant Examiner* — Xiaoting Hu
(74) *Attorney, Agent, or Firm* — Buchanan, Ingersoll & Rooney PC

(57) ABSTRACT

A vacuum pump for supplying a machine assembly with negative pressure, the vacuum pump including a housing featuring a delivery chamber which includes a chamber inlet opening and a chamber outlet opening for a gaseous fluid; a suction port for establishing a fluid connection to the machine assembly; a suction channel which connects the delivery chamber to the suction port; and a relief channel which connects the delivery chamber to a relief opening of the housing; a delivery member which can rotate in the delivery chamber in a forward rotational direction and a reverse rotational direction. The fluid is suctioned into the delivery chamber through the chamber inlet opening and discharged through the chamber outlet opening by rotating the delivery member in the forward rotational direction.

16 Claims, 9 Drawing Sheets

(52) U.S. Cl.
CPC ..... *F04C 29/128* (2013.01); *F04C 2220/10* (2013.01); *F04C 2240/30* (2013.01)

(58) Field of Classification Search
CPC ..... F04C 28/26; F04C 18/3441–3447; F04C 2240/30; F04C 15/066; F04C 15/068
See application file for complete search history.

(56) References Cited

U.S. PATENT DOCUMENTS

| | | | | |
|---|---|---|---|---|
| 2013/0022485 | A1* | 1/2013 | Hunter | F04C 25/02 418/3 |
| 2018/0238331 | A1* | 8/2018 | Hammer | F04C 29/126 |
| 2019/0170141 | A1 | 6/2019 | Ott et al. | |
| 2020/0116150 | A1* | 4/2020 | Heaps | F04C 28/06 |
| 2020/0309126 | A1* | 10/2020 | Hattori | F04C 28/24 |

FOREIGN PATENT DOCUMENTS

| | | | | |
|---|---|---|---|---|
| DE | 102017128972 | A1 | 6/2019 | |
| EP | 0255920 | A2 | 2/1988 | |
| EP | 2853747 | A1 * | 4/2015 | F04C 28/06 |
| WO | WO-2004044431 | A2 * | 5/2004 | F04C 18/3441 |
| WO | WO-2008009251 | A1 * | 1/2008 | F04C 18/3442 |
| WO | WO-2010145633 | A2 * | 12/2010 | F04C 18/3441 |
| WO | 2018224117 | A1 | 12/2018 | |

OTHER PUBLICATIONS

German Examination Report for German Application No. 10 2020 111 301.3, dated Aug. 30, 2022, with translation, 11 pages.

* cited by examiner

VACUUM PUMP

CROSS REFERENCE TO RELATED APPLICATION

This application claims benefit of priority from German Patent Application No. 10 2020 111 301.3, filed Apr. 24, 2020. The contents of this application are incorporated herein by reference.

FIELD OF THE INVENTION

The invention relates to a vacuum pump, in particular a vane cell pump, for supplying a machine assembly, in particular a motor vehicle machine assembly, with negative pressure. In preferred embodiments, the machine assembly is a brake servo of a motor vehicle. The vacuum pump comprises a housing featuring a delivery chamber, wherein the delivery chamber comprises at least one chamber inlet opening and at least one chamber outlet opening for a fluid, preferably a gaseous fluid. When the pump is operating normally, the chamber inlet opening is preferably formed in a low-pressure region of the delivery chamber, and the chamber outlet opening is preferably formed in a high-pressure region of the delivery chamber. The vacuum pump also comprises a delivery member which is mounted such that it can rotate in the delivery chamber, wherein the fluid can be suctioned into the delivery chamber through the chamber inlet opening and discharged through the chamber outlet opening by rotating the delivery member in a forward rotational direction. Operating the vacuum pump by rotating the delivery member in the forward rotational direction represents the normal operation of the vacuum pump and/or normal pump operations. The vacuum pump can be connected or is already connected to the machine assembly via a suction port which is connected to the delivery chamber via a suction channel.

BACKGROUND OF THE INVENTION

Vacuum pumps in motor vehicles, for example for operating brake servos, must response with as little delay as possible and provide the corresponding negative pressure as immediately as possible when negative pressure is needed at a machine assembly. Providing negative pressure to the machine assembly can be of significant relevance to the safety of the motor vehicle, in particular in the case of brake servos. Vacuum pumps must therefore operate reliably and with no susceptibility to outage. In conventionally designed vacuum pumps, this reliability can be disrupted in operating conditions which deviate from normal operations. It can then transpire that the delivery member of vacuum pumps rotates in a reverse rotational direction instead of a forward rotational direction, which corresponds to normal pump operations. This operating state can for example occur in a motor vehicle if it is rolled backwards, with the engine switched off, when being unloaded from a car transporter and is slowed, while still rolling, by engaging the clutch with the engine still switched off. This operating state can be particularly damaging to the vacuum pump, in particular with regard to any lubricating oil present within the delivery chamber, which is for example suctioned by the negative pressure prevailing in the delivery chamber when the pump is switched off. When the pump is suddenly rotated in reverse, this is damaging in that the oil situated in the delivery chamber causes a very high drive torque of the pump, such that the delivery member, for example a vane of the negative pressure pump, can be destroyed or otherwise damaged by being overloaded.

SUMMARY OF THE INVENTION

Therefore an aspect of the invention aims to overcome these disadvantages and to design the vacuum pump to be less susceptible to outage and to improve the service life of the pump.

An aspect of the invention relates in particular to a vacuum pump, preferably a vane cell pump, for supplying a machine assembly with negative pressure. The vacuum pump comprises a housing featuring a delivery chamber which comprises a chamber inlet opening and a chamber outlet opening for a fluid, preferably a gaseous fluid. The gaseous fluid can in particular be air. When the delivery member rotates in a forward rotational direction, the chamber inlet opening is preferably formed in a low-pressure region of the delivery chamber which is connected in fluid communication with the machine assembly via a suction port. When the delivery member rotates in the forward rotational direction, the chamber outlet opening by contrast is preferably arranged in a high-pressure region of the delivery chamber and preferably connects it in fluid communication with the environment of the vacuum pump. The chamber inlet opening and/or the chamber outlet opening is/are preferably formed in the radial boundary surface of the delivery chamber.

The vacuum pump comprises a suction channel which emerges into the delivery chamber via the chamber inlet opening and connects the delivery chamber to a suction port. The vacuum pump can be connected directly to the machine assembly via the suction port or indirectly, for example via another feed conduit. The low-pressure region of the delivery chamber is thus connected in fluid communication with the machine assembly via the suction port and the suction channel when the delivery member rotates in the forward rotational direction.

The vacuum pump also comprises a delivery member which is mounted such that it can rotate in the delivery chamber, wherein the fluid, in particular a gaseous fluid such as for example air, is suctioned into the delivery chamber through the chamber inlet opening and discharged through the chamber outlet opening by rotating the delivery member in the forward rotational direction. The fluid is preferably discharged via a discharge opening which is formed in the housing of the vacuum pump and connected to the chamber outlet opening. The chamber outlet opening is connected in fluid communication with the discharge opening via a discharge channel.

In addition to the delivered gaseous fluid, lubricating oil which is provided in the delivery chamber for lubricating the moving parts and continuously replenished into the delivery chamber is also discharged via the discharge opening. The lubricating oil serves to lubricate the delivery member, in particular the slide bearing of the rotor or delivery member. In vane cell pumps, it is in particular advantageous to also lubricate the radial boundary surface of the delivery chamber by means of a film of oil, such that the tip(s) of the rotor vane(s) can more easily slide along the radial boundary surface of the delivery chamber. The lubricating oil also serves to seal off gaps if there are gaps formed in the delivery chamber or adjoining the delivery chamber. Said lubricating oil is continuously outputted to the environment, while the pump is operating normally, via the chamber outlet opening and the discharge opening connected to the chamber outlet opening via the discharge channel.

In the field of motor vehicle technology, vacuum pumps such as the invention preferably relates to are often attached in or near the oil reservoir, such that the discharged lubricating oil can flow directly back into the reservoir. However, one consequence of this arrangement is often that lubricating oil is additionally suctioned from the reservoir into the delivery chamber, after the vacuum pump has been switched off, due to the negative pressure prevailing in the delivery chamber. When the vacuum pump is re-started, the excess lubricating oil is channeled back into the reservoir again via the discharge opening, such that the drive torque can be significantly reduced.

In preferred embodiments, a main valve prevents fluid from being suctioned through the discharge opening, in particular when the delivery member rotates in a reverse rotational direction, and enables the fluid, in particular the gaseous fluid delivered, to be discharged and lubricating oil to be simultaneously discharged when the delivery member rotates in the forward rotational direction. The main valve is advantageously arranged in the region of the discharge opening, but can also be arranged along the discharge channel. In particularly preferred embodiments, the valve body seat of the main valve encloses the discharge opening.

When the delivery member rotates in the forward rotational direction, the discharge channel preferably extends downstream of the chamber outlet opening as far as the main valve, i.e. the discharge channel connects the delivery chamber in fluid communication with the pump environment via the discharge opening when the delivery member rotates in the forward rotational direction. Alternatively, the delivered fluid can serve to supply another machine assembly with a positive pressure, such that the discharge channel connects the delivery chamber in fluid communication with the corresponding machine assembly via the discharge opening when the delivery member rotates in the forward rotational direction. The fluid in the delivery chamber is preferably drained into the pump environment via the discharge opening when the delivery member rotates in the forward rotational direction.

In particularly preferred embodiments, the main valve is embodied as a reflux valve which opens the discharge channel and in particular the discharge opening when the delivery member rotates in the forward rotational direction and closes the discharge channel and in particular the discharge opening when the delivery member rotates in the reverse rotational direction. The valve body of the main valve can in particular be formed by a spring-elastic valve tongue, for example in the form of a leaf spring, wherein the main valve comprises a valve body seat and an abutment for the valve body. In other words, the main valve can be formed as a reed valve comprising a spring-elastic valve tongue and an abutment for the valve tongue.

Furthermore, a reflux valve protects the machine assembly against fluid, in particular air and/or lubricant, flowing back when the delivery member rotates in the reverse rotational direction. The reflux valve separates the suction channel from the machine assembly when the delivery member rotates in the reverse rotational direction, and opens the suction channel when the delivery member rotates in the forward rotational direction. The reflux valve can be formed in the region of the suction port or along the suction channel. The reflux valve can be arranged in the region of the vacuum pump, in particular in the pump housing, but is preferably formed for example in a feed conduit to the machine assembly or in the region of the machine assembly which is supplied with negative pressure.

In addition to the discharge channel and the suction channel, the pump comprises a relief channel. The relief channel connects the delivery chamber, preferably the low-pressure region of the delivery chamber when the delivery member rotates in the forward rotational direction, to a relief opening of the pump housing. The relief channel connects the delivery chamber to the environment of the vacuum pump via the relief opening. The suction channel extends, preferably within the pump housing, from the chamber inlet opening to the suction port.

Lubricating oil is preferably transported away from the delivery chamber via the relief opening, in particular in operating states deviating from normal operations of the vacuum pump, and outputted to the environment. In particular when the vacuum pump is switched off, lubricating oil can additionally accumulate in the delivery chamber of the vacuum pump, wherein said lubricating oil can be discharged from the delivery chamber via the relief channel and the relief opening connected to the relief channel if the delivery member suddenly rotates in the reverse rotational direction.

A relief valve is formed in the region of the relief channel in order to prevent fluid from being suctioned via the relief opening and the efficacy of the pump thus being reduced. The relief valve is designed to close the relief channel when the delivery member rotates in the forward rotational direction and to open the relief channel when the delivery member rotates in the reverse rotational direction. The relief valve is preferably attached in the region of the relief opening, such that the relief valve closes the relief opening when the delivery member rotates in the forward rotational direction and opens the relief opening when the delivery member rotates in the reverse rotational direction.

The relief channel can then be formed separately from the suction channel in the pump housing. The relief channel preferably emerges into the suction channel of the pump in a channel intersection, i.e. the relief channel preferably extends from the relief opening of the pump housing up to a channel intersection at which the relief channel emerges into the suction channel. The relief channel preferably emerges into the suction channel upstream of the chamber inlet opening in relation to the flow which is established in the suction channel when the delivery member rotates in the forward rotational direction.

The relief channel particularly preferably emerges into the suction channel at a distance from the chamber inlet opening by a length d measured along the suction channel, wherein the length d is measured from the chamber inlet opening along the suction channel in an upstream direction when the delivery member rotates in the forward rotational direction. The relief channel thus emerges into the suction channel in the upstream direction of the chamber inlet opening when the delivery member rotates in the forward rotational direction.

If a reflux valve is provided in the suction channel, the channel intersection at which the relief channel emerges into the suction channel is formed between the reflux valve and the chamber inlet opening. The reflux valve is designed to connect the machine assembly in fluid communication with the delivery chamber when the delivery member rotates in the forward rotational direction and to separate the machine assembly from the delivery chamber when the delivery member rotates in the reverse rotational direction. The relief channel emerges downstream of the reflux valve and upstream of the chamber inlet opening in relation to the flow established in the suction channel when the delivery member rotates in the forward rotational direction.

The length d of the suction channel from the chamber inlet opening up to the channel intersection at which the relief channel emerges into the suction channel is advantageously at least as large as a smallest width W of the chamber inlet opening, i.e. the length d of the suction channel from the chamber inlet opening up to the channel intersection preferably corresponds to at least the smallest width W of the chamber inlet opening. The length d of the suction channel from the chamber inlet opening up to the channel intersection particularly preferably corresponds to at least twice the smallest width W of the chamber inlet opening or three times the smallest width W of the chamber inlet opening.

The smallest width W of the chamber inlet opening is understood to mean the smallest extent of the chamber inlet opening when the radial boundary surface of the delivery chamber is unfurled. The chamber inlet opening can thus extend to different extents in the axial direction and in the circumferential direction of the radial boundary surface, wherein the smallest width W denotes its smallest extent, irrespective of its direction.

Since the delivery chamber is substantially formed by a cylindrical cavity in the housing, the unfurled radial boundary surface, in which the chamber inlet opening is advantageously formed, corresponds to the surface area of the cylindrical cavity. If the chamber inlet opening is circular, the smallest width W of the chamber inlet opening would correspond to the diameter of the chamber inlet opening. The chamber inlet opening is advantageously formed elliptically.

It should be noted that the geometry of the chamber inlet opening does not allow any conclusions to be drawn about the flow cross-section of the suction channel. The suction channel can for example be formed by a circular-cylindrical bore which extends along a secant which intersects the delivery chamber. This results in an elliptical chamber inlet opening in the unfurled radial boundary surface of the delivery chamber.

In preferred embodiments, the flow resistance of the relief channel is greater than the flow resistance of the suction channel. This can for example be achieved by the mean flow cross-section of the suction channel being larger than the mean flow cross-section of the relief channel. The mean flow cross-section is understood to mean the arithmetic mean of the individual flow cross-sections along the corresponding channel. In preferred embodiments, the relief channel exhibits a constant flow cross-section, such that the mean flow cross-section is equal to the flow cross-section at any point in the relief channel. The flow cross-section of the channel intersection at which the relief channel emerges into the suction channel is preferably smaller than the mean flow cross-section of the suction channel in the region of the channel intersection.

The relief channel extends from the channel intersection, at which the relief channel emerges into the suction channel, up to a relief opening, wherein the relief opening is formed in the upstream direction of the channel intersection when the delivery member rotates in the forward rotational direction. The relief channel preferably exhibits a constant flow cross-section over its entire length. The relief channel particularly preferably exhibits a circular flow cross-section.

The relief opening and the channel intersection at which the relief channel emerges into the suction channel are preferably equal in size. The length of the relief channel corresponds to the length of the relief channel between the channel intersection, at which the relief channel emerges into the suction channel, and the relief opening. The relief channel preferably exhibits a linear profile over its length, i.e. the relief channel preferably corresponds to the projection of the relief opening along a straight line of length.

In preferred embodiments, the relief channel is formed as a blind bore which intersects or crosses the suction channel, i.e. the relief channel does not completely penetrate the pump housing and in particular does not intersect the radial boundary surface of the delivery chamber, wherein the base of the blind bore can be formed by a boundary wall of the suction channel.

In preferred embodiments, the mean flow cross-section of the relief channel and the mean flow cross-section of the discharge channel differ from each other, wherein the mean flow cross-section is understood to mean the arithmetic mean of the individual flow cross-sections along the corresponding channel. In particularly preferred embodiments, the mean flow cross-section of the discharge channel is larger than the mean flow cross-section of the relief channel. In particular, the mean flow cross-section of the discharge channel preferably exhibits at least one and a half times the mean flow cross-section of the relief channel.

In addition to the discharge opening of the discharge channel and the relief opening of the relief channel, at least one of the relief channel and the discharge channel can comprise a pressure equalization opening via which the delivery chamber is connected, preferably permanently, in fluid communication with the environment. The pressure equalization opening serves to equalize the pressure in the delivery chamber when the vacuum pump is at a stop, such that the negative pressure in the delivery chamber can be dissipated, wherein the flow resistance of the pressure equalization opening is at least twice the flow resistance of the relief channel and/or discharge channel. The pressure equalization opening is preferably formed in the region of the relief valve and/or the main valve.

In preferred embodiments, the relief valve is embodied as a reflux valve which closes the relief channel when the delivery member rotates in the forward rotational direction and opens the relief channel when the delivery member rotates in the reverse rotational direction. The relief valve is preferably formed in the region of the relief opening, such that the relief valve closes the relief opening when the delivery member rotates in the forward rotational direction and opens it when the delivery member rotates in the reverse rotational direction.

Preferably, the relief opening simultaneously forms the valve opening of the relief valve. The valve body of the relief valve can in particular be formed by a spring-elastic valve tongue, for example in the form of a leaf spring. The relief valve also comprises a valve body seat and an abutment for the valve body. In other words, the relief valve can be formed as a reed valve comprising a spring-elastic valve tongue and an abutment for the valve tongue. In preferred embodiments, the valve body seat is formed by the pump housing which surrounds the relief opening, i.e. the valve body seat of the relief valve preferably encloses the relief opening in the circumferential direction.

The relief opening and the discharge opening are preferably arranged next to each other in the circumferential direction of the pump housing. Preferably, the discharge opening can be closed by the main valve, and the relief opening can be closed by the relief valve. In particularly advantageous embodiments, the relief opening is formed in front of the discharge opening, in the forward rotational direction of the delivery member, in the pump housing.

The abutment of the relief valve and the abutment of the main valve are advantageously connected to each other in a common fastening region, wherein the fastening region is understood to mean the region of the abutment via which the abutment is connected to the housing. Screws or blind rivets can for example serve as fastening elements. It is however also conceivable for the fastening region of the abutment to be joined to the housing in a material fit, for example by welding or soldering. Adhesive connections are also conceivable.

The abutment of the relief valve and the abutment of the main valve are preferably connected to each other in an L shape in a plan view via the common fastening region, i.e. the abutment of the relief valve and the abutment of the main valve preferably protrude from a common fastening region at an enclosed angle β.

The enclosed angle β is then preferably less than 180°, in particular less than 150° and particularly preferably less than 120°. The abutment of the relief valve and the abutment of the main valve can protrude in parallel from the common fastening region, such that the angle β enclosed by the abutment of the main valve and the abutment of the relief valve measures approximately 0° with a tolerance of up to 20°. In this case, the abutment of the relief valve and the abutment of the main valve are connected to each other in a U shape in a plan view via the common fastening region. More preferably, the enclosed angle β is more than 40° or more than 60°; particularly preferably, the abutment of the relief valve and the abutment of the main valve enclose a right angle. The angle β particularly preferably measures 90° with a tolerance of at most ±20°.

The abutment of the main valve and the abutment of the relief valve can be produced in one piece. The abutment of the main valve and the abutment of the relief valve can then for example be punched or cut from sheet metal. The abutment of the main valve, the abutment of the relief valve and the common fastening region preferably exhibit a constant thickness b over the entire region. The thickness b of the abutment of the relief valve and the thickness b of the abutment of the main valve preferably measure less than 5 mm, particularly preferably less than 2 mm.

The abutment of the main valve and the abutment of the relief valve can lie in a common plane with the common fastening region, but preferably protrude from the plane formed by the common fastening region at an angle of less than 90°, in particular less than 45°, i.e. the common fastening region and the abutment of the main valve enclose a common angle of more than 90°, in particular more than 135°. The common fastening region and the abutment of the relief valve likewise enclose a common angle of more than 90°, in particular more than 135°.

The relief valve and the main valve are formed as reed valves, in particular double reed valves, i.e. the valve tongue of the relief valve and the valve tongue of the main valve are connected to each other, preferably in a L shape or U shape in a plan view, via a common fastening region, i.e. the valve tongue of the relief valve and the valve tongue of the main valve preferably protrude from a common fastening region at an enclosed angle α.

The enclosed angle α is then preferably less than 180°, in particular less than 150° and particularly preferably less than 120°. The valve tongue of the relief valve and the valve tongue of the main valve can protrude in parallel from the common fastening region, such that the angle α enclosed by the valve tongue of the main valve and the valve tongue of the relief valve measures approximately 0° with a tolerance of up to 20°. In this embodiment, the valve tongue of the relief valve and the valve tongue of the main valve are connected to each other in a U shape in a plan view via the common fastening region. More preferably, the enclosed angle α is more than 40° or more than 60°; particularly preferably, the valve tongue of the relief valve and the valve tongue of the main valve enclose a right angle. The angle α particularly preferably measures 90° with a tolerance of at most ±20°. In this example embodiment, the valve tongue of the relief valve and the valve tongue of the main valve are connected to each other in an L shape in a plan view via the common fastening region.

The valve tongue of the main valve and the valve tongue of the relief valve are preferably produced in one piece. The valve tongue of the relief valve and the valve tongue of the main valve can in particular be formed in one piece, for example punched or cut, from sheet metal, preferably spring sheet metal, wherein the thickness b of the valve tongue of the relief valve, the thickness of the valve tongue of the main valve and the thickness of the common fastening region are preferably equal in size, preferably less than 1 mm and particularly preferably less than 0.5 mm.

The valve tongue of the relief valve and the valve tongue of the main valve lie in a plane with the common fastening region, wherein the valve tongue of the relief valve and the valve tongue of the main valve can be spring-elastically deflected out of the common plane. The deflecting force required to deflect the valve tongue of the main valve and the valve tongue of the relief valve is dimensioned such that the fluid flow established by the vacuum pump when the delivery member rotates in the forward rotational direction and when the delivery member rotates in the reverse rotational direction can deflect the valve tongue of the main valve and the valve tongue of the relief valve.

The main valve and the relief valve operate oppositely, i.e. while the main valve is in an opening position when the delivery member rotates in the forward rotational direction, the relief valve is in a closing position when the delivery member rotates in the forward rotational direction.

The main valve and the relief valve are advantageously formed as double reed valves, i.e. the abutment of the main valve, the abutment of the relief valve, the spring-elastic valve tongue of the main valve and the spring-elastic valve tongue of the relief valve are connected to the housing of the pump via a common fastening element, in particular a fastening screw or a blind rivet. In advantageous embodiments, the abutment of the main valve and the abutment of the relief valve are formed in one piece and overlap the valve tongue of the main valve and the valve tongue of the relief valve, which are likewise formed in one piece, in a radial plan view when installed, i.e. the integrally formed abutments of the main valve and relief valve are the same size or larger than the integrally formed valve tongues of the main valve and relief valve.

Features of the invention are also described in the aspects formulated below. The aspects are worded in the manner of claims and can substitute for them. Features disclosed in the aspects can also supplement and/or qualify the claims, indicate alternatives with respect to individual features and/or broaden claim features. Bracketed reference signs refer to example embodiments of the invention illustrated below in figures. They do not restrict the features described in the aspects to their literal sense as such, but do conversely indicate preferred ways of implementing the respective feature.

Aspect 1. A vacuum pump, in particular a vane cell pump, for supplying a machine assembly with negative pressure, the vacuum pump comprising:

1.1 a housing (30) featuring:

1.1.1 a delivery chamber which comprises a chamber inlet opening (40) and a chamber outlet opening (50) for a gaseous fluid such as for example air;

1.1.2 a suction port (46) for establishing a fluid connection to the machine assembly;

1.1.3 a suction channel (41) which emerges into the delivery chamber via the chamber inlet opening (40) and connects the delivery chamber to the suction port (46); and 1.1.4 a relief channel (42) which connects the delivery chamber to a relief opening (43) of the housing (30);

1.2 a delivery member (10, 20) which can rotate in the delivery chamber in a forward rotational direction and a reverse rotational direction, wherein the fluid is suctioned into the delivery chamber through the chamber inlet opening (40) and discharged through the chamber outlet opening (50) by rotating the delivery member in the forward rotational direction; and 1.3 a relief valve (60) for closing the relief opening (43) when the delivery member (10, 20) rotates in the forward rotational direction and opening the relief opening (43) when the delivery member (10, 20) rotates in the reverse rotational direction, 1.4 wherein the relief channel (42) emerges into the suction channel (41).

Aspect 2. The vacuum pump according to the preceding aspect, wherein the relief channel (42) emerges into the suction channel (41) at a distance from the chamber inlet opening (40) by a length (d) measured along the suction channel (41).

Aspect 3. The vacuum pump according to any one of the preceding aspects, wherein the relief channel (42) emerges into the suction channel (41) upstream of the chamber inlet opening (40) in relation to the flow which is established in the suction channel (41) when the delivery member (10, 20) rotates in the forward rotational direction.

Aspect 4. The vacuum pump according to any one of the preceding aspects, wherein the suction channel (41) exhibits a length (d) from the chamber inlet opening (40) to a channel intersection (44) at which the relief channel (42) emerges into the suction channel (41) which is at least as large as a smallest width (W) of the chamber inlet opening (40).

Aspect 5. The vacuum pump according to any one of the preceding aspects, wherein the suction channel (41) emerges into the delivery chamber via the chamber inlet opening (40) in a downstream direction in relation to the flow established in the suction channel (41) when the delivery member (10, 20) rotates in the forward rotational direction, and wherein a channel intersection (44) at which the relief channel (42) emerges into the suction channel (41) is situated in an upstream direction of the chamber inlet opening (40).

Aspect 6. The vacuum pump according to any one of the preceding aspects, wherein the relief opening (43) and a channel intersection (44) at which the relief channel (42) emerges into the suction channel (41) are equal in size.

Aspect 7. The vacuum pump according to any one of the preceding aspects, wherein the housing (30) comprises a discharge opening (53) connected to the chamber outlet opening (50), and the vacuum pump comprises a main valve (70) in order to prevent the fluid from being suctioned through the discharge opening (53) and to allow the fluid to be discharged through the discharge opening (53).

Aspect 8. The vacuum pump according to the preceding aspect, wherein the relief valve (60) and the main valve (70) are each formed as a reed valve comprising a spring-elastic valve tongue (62, 72) and an abutment (63, 73) for the valve tongue (62, 72).

Aspect 9. The vacuum pump according to the preceding aspect, wherein the valve tongue (62) of the relief valve (60) and the valve tongue (72) of the main valve (70) are connected to each other, preferably in an L shape or U shape, via a common fastening region.

Aspect 10. The vacuum pump according to any one of the preceding two aspects, wherein the abutment (63) of the relief valve (60) and the abutment (73) of the main valve (70) are connected to each other, preferably in an L shape or U shape, via a common fastening region.

Aspect 11. The vacuum pump according to any one of the preceding three aspects, wherein the relief valve (60) and the main valve (70) together form a double reed valve.

Aspect 12. The vacuum pump according to any one of the preceding five aspects, wherein the valve tongue (62) of the relief valve (60) and the valve tongue (72) of the main valve (70) are produced in one piece and protrude, as viewed in a plan view, from a common fastening region at an enclosed angle $\alpha$, wherein $\alpha<180°$ or $\alpha<150°$ or $\alpha<120°$.

Aspect 13. The vacuum pump according to the preceding aspect, wherein $\alpha>40°$ or $\alpha>60°$, wherein a is preferably 90° with a deviation of at most ±□20°.

Aspect 14. The vacuum pump according to any one of the preceding six aspects, wherein the abutment (63) of the relief valve (60) and the abutment (73) of the main valve (70) are produced in one piece and protrude, as viewed in a plan view, from a common fastening region at an enclosed angle $\beta$, wherein $\beta<180°$ or $\beta<150°$ or $\beta<120°$.

Aspect 15. The vacuum pump according to the preceding aspect, wherein $\beta>40°$ or $\beta>60°$, wherein $\beta$ is preferably 90° with a deviation of at most ±□20°.

Aspect 16. The vacuum pump according to any one of the preceding eight aspects, wherein the abutment (63) of the relief valve (60) and the abutment (73) of the main valve (70) and/or the valve tongue (62) of the relief valve (60) and the valve tongue (72) of the main valve (70) are connected to the housing of the pump via a common fastening region.

Aspect 17. The vacuum pump according to the preceding aspect, wherein the connecting element is formed by a screw or a blind rivet.

Aspect 18. The vacuum pump according to any one of the preceding aspects, wherein the housing (30) comprises a discharge opening (53) which is connected to the chamber outlet opening (50) via a discharge channel (52).

Aspect 19. The vacuum pump according to Aspect 7, wherein a discharge channel (52) extends downstream of the chamber outlet opening (50) as far as a main valve (70) when the delivery member (10, 20) rotates in the forward rotational direction.

Aspect 20. The vacuum pump according to the preceding aspect, wherein the main valve (70) connects the delivery chamber in fluid communication with the pump environment or another assembly via the discharge opening (53) when the delivery member (10, 20) rotates in the forward rotational direction.

Aspect 21. The vacuum pump according to any one of the preceding two aspects, wherein the main valve (70) closes the discharge opening (53) when the delivery member (10, 20) rotates in the reverse rotational direction and opens it when the delivery member (10, 20) rotates in the forward rotational direction.

Aspect 22. The vacuum pump according to any one of the preceding three aspects, wherein a valve body seat (71) of the main valve (70) encloses the discharge opening (53).

Aspect 23. The vacuum pump according to any one of the preceding five aspects, wherein the mean flow cross-section of the relief channel (42) and the mean flow cross-section of the discharge channel (52) differ from each other.

Aspect 24. The vacuum pump according to any one of the preceding aspects, wherein the flow resistance of the relief channel (42) is greater than the flow resistance of the suction channel (41).

Aspect 25. The vacuum pump according to any one of the preceding aspects, wherein the flow cross-section of the channel intersection (44) is smaller than the mean flow cross-section of the suction channel (41) in the region of the channel intersection (44).

Aspect 26. The vacuum pump according to any one of the preceding aspects, wherein the relief opening (43) is enclosed by a valve body seat (61) of the relief valve (60) in the circumferential direction.

Aspect 27. The vacuum pump according to any one of the preceding eight aspects, wherein at least one of the relief channel (42) and the discharge channel (52) comprises a pressure equalization opening via which the delivery chamber is connected, preferably permanently, in fluid communication with the environment.

Aspect 28. The vacuum pump according to the preceding aspect, wherein the flow resistance of the pressure equalization opening is at least twice the flow resistance of the relief channel (42) and/or discharge channel (52).

Aspect 29. The vacuum pump according to any one of the preceding two aspects, wherein the pressure equalization opening is formed in the region of the relief valve (60) and/or main valve (70).

Aspect 30. The vacuum pump according to any one of the preceding aspects, wherein a reflux valve (45) separates the suction channel (41) from the machine assembly when the delivery member (10, 20) rotates in the reverse rotational direction.

Aspect 31. The vacuum pump according to the preceding aspect, wherein the relief channel (42) emerges into the suction channel (41) upstream of the reflux valve (45) and downstream of the chamber inlet opening (40) in relation to the flow which is established in the suction channel (41) when the delivery member (10, 20) rotates in the forward rotational direction.

Aspect 32. The vacuum pump according to any one of the preceding aspects, wherein the suction channel (41) exhibits a length (d) from the chamber inlet opening (40) up to a channel intersection (44) at which the relief channel (42) emerges into the suction channel (41) which is at least as large as the diameter of a circle whose circular area corresponds to the cross-sectional area of the channel inlet opening (40).

Aspect 33. The vacuum pump according to any one of the preceding aspects, wherein the vacuum pump is designed to suction and discharge air and to lubricate by means of lubricating oil.

Aspect 34. The vacuum pump according to any one of the preceding aspects, wherein the vacuum pump is designed to connect to a lubricating oil circuit of a motor vehicle and in particular enable lubricating oil to be replenished into the delivery chamber.

Aspect 35. The vacuum pump according to any one of the preceding aspects, wherein the machine assembly is a brake servo of a motor vehicle.

Aspect 36. The vacuum pump according to any one of the preceding aspects, characterized in that the vacuum pump is arranged in a motor vehicle and connected to a brake servo of the motor vehicle via the suction port (46) in order to supply the brake servo with negative pressure.

Aspect 37. A brake system of a motor vehicle, comprising a brake servo and a vacuum pump according to any one of the preceding aspects, wherein the vacuum pump is connected to the brake servo via the suction port (46) in order to supply the brake servo with negative pressure.

BRIEF DESCRIPTION OF THE DRAWINGS

The invention is explained below on the basis of example embodiments. Features disclosed by the example embodiments advantageously develop the subject-matter of the claims, the subject-matter of the aspects and the embodiments explained above.

There is shown.

DETAILED DESCRIPTION OF THE PREFERRED EMBODIMENTS

Figure 1:
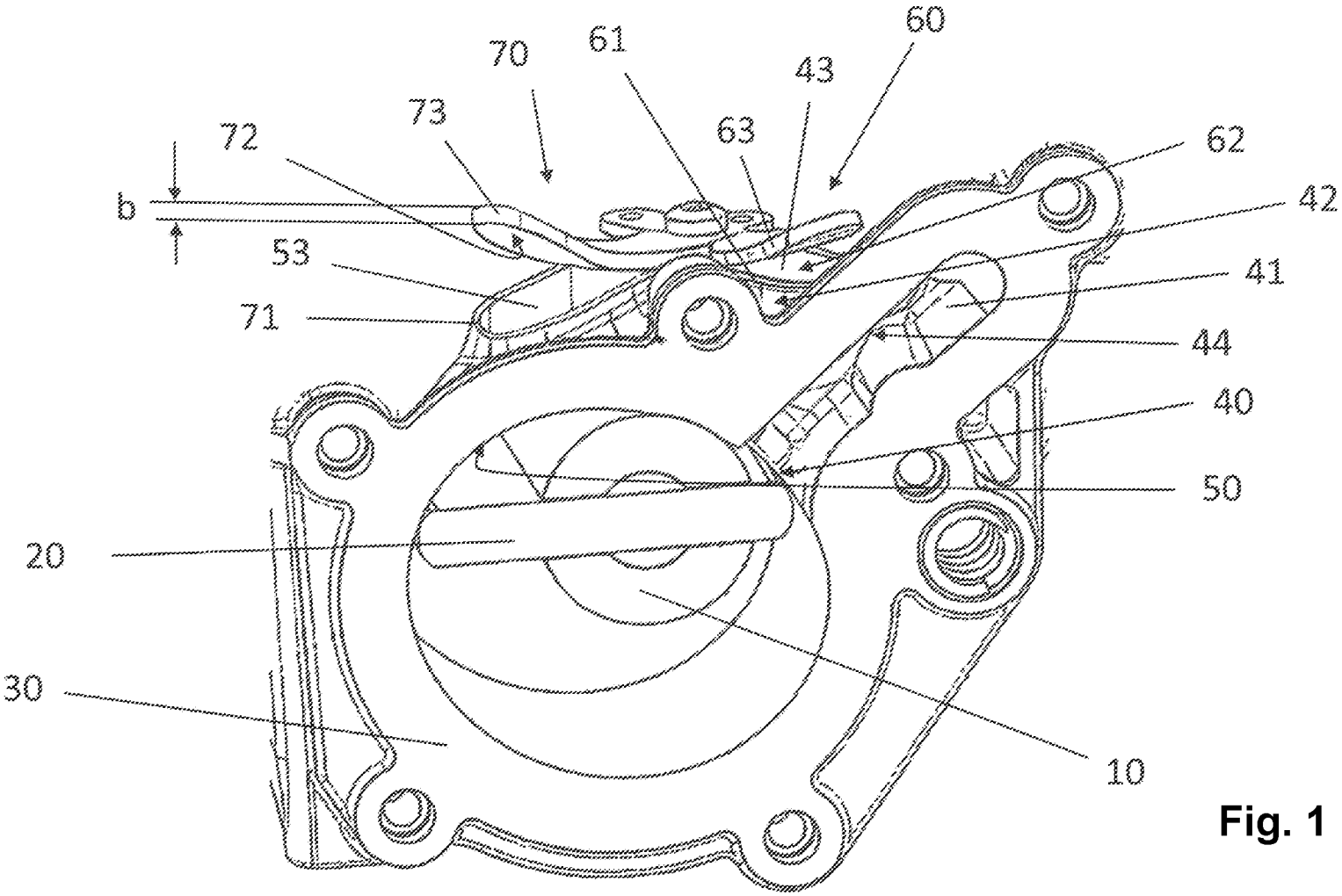
FIG. 1 an isometric view of a first example embodiment of the vacuum pump.

FIG. 1 discloses a vacuum pump of a first example embodiment in an isometric view. The vacuum pump is a vane cell pump comprising a delivery member 10, 20, wherein the delivery member comprises a rotor 10 and a vane 20. The delivery member 10, 20 is mounted such that it can rotate in a forward rotational direction and a reverse rotational direction in a delivery chamber which is formed in a cylindrical cavity in the pump housing 30. The delivery chamber comprises a chamber inlet opening 40 and a chamber outlet opening 50. By rotating the delivery member 10, 20 in the forward rotational direction, fluid is suctioned via the chamber inlet opening 40 and discharged through the chamber outlet opening 50. A suction channel 41 which extends upstream of the chamber inlet opening 40 in relation to a flow formed when the delivery member 10, 20 rotates in the forward rotational direction extends as far as a suction port 46 (not shown in more detail). A machine assembly can be connected to the vacuum pump via the suction port 46, directly or via another feed conduit, such that the vacuum pump can supply the machine assembly with negative pressure.

A reflux valve (also not shown) which is formed in the region of the suction port 46 opens the suction channel 41 when the delivery member 10, 20 rotates in the forward rotational direction and closes it when the delivery member 10, 20 rotates in the reverse rotational direction. The suction channel 41 extends from the suction port 46 up to the delivery chamber, wherein the chamber inlet opening 40 represents the point at which the suction channel 41 emerges into the delivery chamber.

In an upstream direction from the chamber inlet opening 40 in relation to a flow formed when the delivery member 10, 20 rotates in the forward rotational direction, a relief channel 42 diverges from the suction channel 41 and/or emerges into the suction channel 41. The relief channel 42 connects the delivery chamber to a relief opening 43 of the housing 30. The channel intersection 44 at which the relief channel 42 emerges into the suction channel 41 is situated upstream of the chamber inlet opening 40 and downstream of the suction port 46 (not shown) in relation to a flow formed when the delivery member 10, 20 rotates in the forward rotational direction. In other words, the channel intersection 44 at which the relief channel 42 emerges into the suction channel 41 is formed between the chamber inlet opening 40 and the suction port 46 in relation to the suction channel 41.

The relief channel 42 extends from the channel intersection 44 up to a relief opening 43. The relief opening 43 is closed by a relief valve 60 when the delivery member 10, 20 rotates in the forward rotational direction and is opened by the relief valve 60 when the delivery member 10, 20 rotates in the reverse rotational direction. The relief valve 60 is formed in the region of the relief opening 43. The relief valve 60 is formed as a reed valve comprising a spring-elastic valve tongue 62 and an abutment 63 for the spring-elastic valve tongue 62. Depending on the operating state of the vacuum pump, i.e. the rotational direction of the delivery member 10, 20, the spring-elastic valve tongue 62 either abuts the abutment 63 of the relief valve 60 and thus opens the relief opening 43 or overlaps the relief opening 43 such that the relief opening 43 is closed by the spring-elastic valve tongue 62.

As can be seen from FIG. 1, the relief valve 60 forms a double reed valve together with a main valve 70. The main valve 70, which forms the double reed valve together with the relief valve 60, closes a discharge opening 53 which is connected to the chamber outlet opening 50 via a discharge channel 52. The discharge opening 53 serves to discharge the delivered fluid, in particular air, into the environment of the vacuum pump when the delivery member 10, 20 rotates in the forward rotational direction.

The main valve 70 is formed as a reed valve comprising a spring-elastic valve tongue 72 and an abutment 73 for the spring-elastic valve tongue 72. The main valve 70 is formed in the region of the discharge opening 53, wherein the spring-elastic valve tongue 72 is designed to be pivotable between the abutment 73 and the discharge opening 53. Depending on the operating state of the vacuum pump, i.e. the rotational direction of the delivery member 10, 20, the spring-elastic valve tongue 72 opens or closes the discharge opening 53. The main valve 70 connects the delivery chamber in fluid communication with the environment of the vacuum pump via the chamber outlet opening 50 when the delivery member 10, 20 rotates in the forward rotational direction and separates the delivery chamber from the environment of the vacuum pump when the delivery member 10, 20 rotates in the reverse rotational direction, i.e. the main valve 70 operates in the opposite way to the relief valve 60.

While the vacuum pump is in operation, the relief valve 60 separates the fluid-communication connection between the delivery member and the environment of the vacuum pump via the relief opening 43 when the delivery member 10, 20 rotates in the forward rotational direction, while the main valve 70 opens the connection between the delivery chamber and the environment of the vacuum pump via the discharge opening 53. Conversely, the relief valve 60 opens the relief opening 43 when the delivery member 10, 20 rotates in the reverse rotational direction, such that a fluid-communication connection is established between the delivery chamber and the environment of the vacuum pump via the relief opening 43, while the main valve 70 closes the discharge opening 53, such that the fluid-communication connection between the delivery chamber and the environment of the vacuum pump via the discharge opening 53 is interrupted. In other words, the relief valve 60 is in a closing position, while the main valve 70 is in an opening position, when the delivery member 10, 20 rotates in the forward rotational direction. Correspondingly, the relief valve 60 is in an opening position, while the main valve 70 is in a closing position, when the delivery member 10, 20 rotates in the reverse rotational direction.

When the main valve 70 is in its closing position, the spring-elastic valve tongue 72 completely overlaps the discharge opening 53 in a plan view, such that no fluid can flow through the discharge opening 53. Similarly, when the relief valve 60 is in its closing position, the spring-elastic valve tongue 62 completely overlaps the relief opening 43 in a plan view, such that no fluid can flow via the relief opening 43.

As already mentioned, the relief valve 60 and the main valve 70 together form a double reed valve. This means the abutment 63 of the relief valve 60 and the abutment 73 of the main valve 70 protrude from a common fastening region. The abutment 63 of the relief valve 60 and the abutment 73 of the main valve 70 are produced in one piece with the common fastening region. The abutment 63 of the relief valve 60, the abutment 73 of the main valve 70 and the common fastening region are formed together from sheet metal, in particular by being punched or cut out. The abutment 63 of the relief valve 60, the abutment 73 of the main valve 70 and the common fastening region exhibit a constant thickness b over their entire area.

Figure 2:
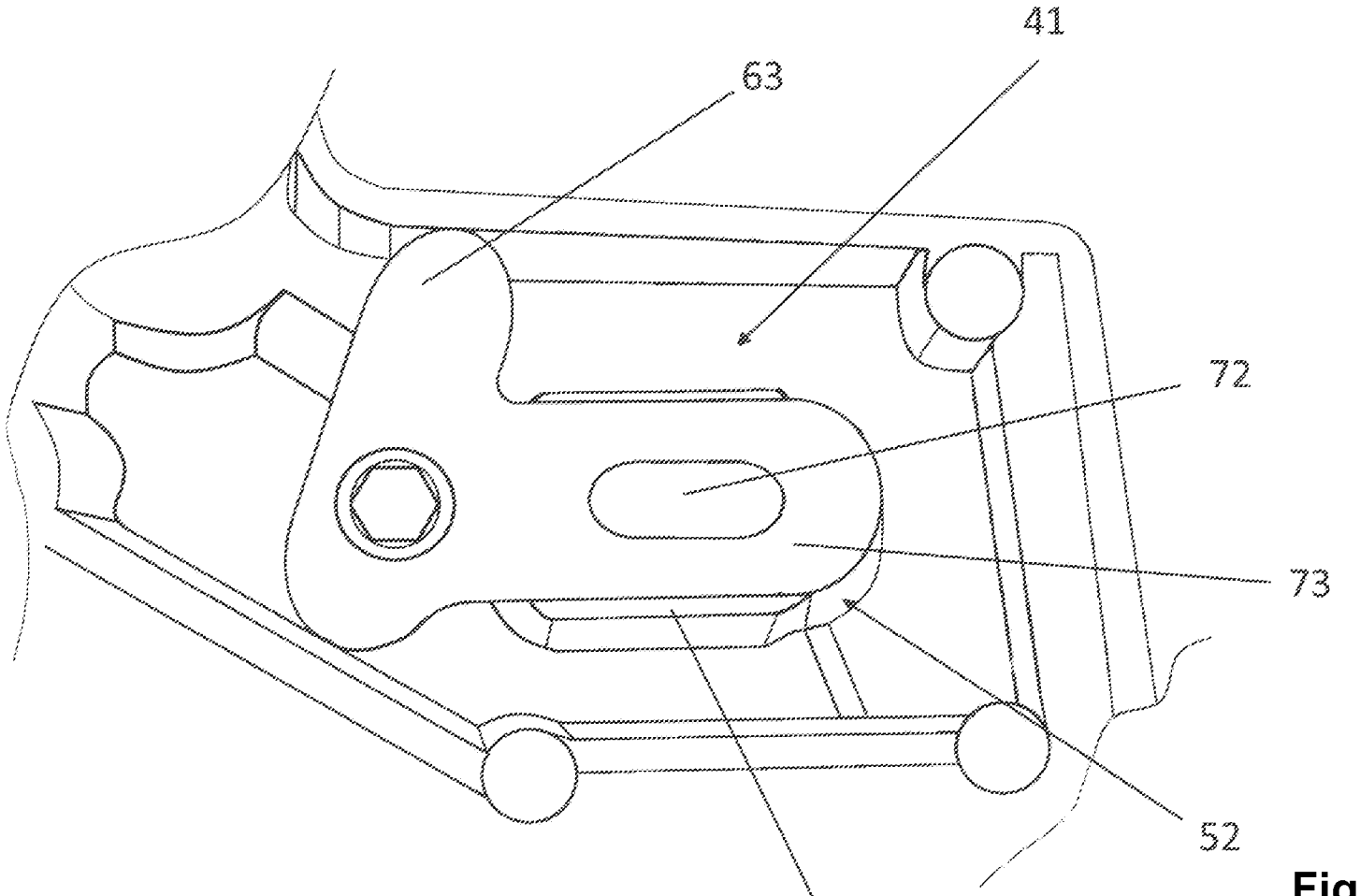
FIG. 2 a plan view onto the relief valve and main valve of the first example embodiment.

As can be seen in FIG. 1 and FIG. 2, the abutment 63 of the relief valve 60 is connected to the abutment 73 of the main valve 70 in an L shape via the common fastening region, i.e. the abutment 63 of the relief valve 60 and the abutment 73 of the main valve 70 protrude from the common fastening region at an enclosed angle $\beta$ of 90° with a deviation of at most ±20°. The abutment 73 of the main valve 70 protrudes further from the common fastening region than the abutment 63 of the relief valve 60, i.e. the abutment 73 of the main valve 70 forms a longer limb than the abutment 63 of the relief valve 60. It will be obvious to the person skilled in the art that it would also be possible for the abutment 63 of the relief valve 60 to protrude further from the common fastening region than the abutment 73 of the main valve 70 or for the two to protrude to the same extent.

The statements just made apply similarly to the spring-elastic valve tongue 72 of the main valve 70 and the spring-elastic valve tongue 62 of the relief valve 60, i.e. the spring-elastic valve tongue 62 of the relief valve 60 and the spring-elastic valve tongue 72 of the main valve 70 protrude from a common fastening region, wherein the spring-elastic valve tongue 62 of the relief valve 60 and the spring-elastic valve tongue 72 of the main valve 70 are produced in one piece with the common fastening region, wherein the spring-elastic valve tongue 62 of the relief valve 60 and the spring-elastic valve tongue 72 of the main valve 70 are connected to each other in an L shape via the common fastening region, i.e. the spring-elastic valve tongue 62 of the relief valve 60 and the spring-elastic valve tongue 72 of the main valve 70 protrude from the common fastening region at an enclosed angle $\alpha$ of 90° with a deviation of at most ±20°.

The spring-elastic valve tongue 72 of the main valve 70 protrudes further from the common fastening region than the spring-elastic valve tongue 62 of the relief valve 60, i.e. the spring-elastic valve tongue 72 of the main valve 70 forms a longer limb than the spring-elastic valve tongue 62 of the relief valve 60. Here, too, it will be obvious to the person skilled in the art to for example have the spring-elastic valve tongue 62 of the relief valve 60 protrude further from the common fastening region than the spring-elastic valve tongue 72 of the main valve 70 or to have the two protrude to the same extent.

The spring-elastic valve tongue 72 of the main valve 70 and the spring-elastic valve tongue 62 of the relief valve 60 are formed together with the common fastening region from sheet metal, in particular spring sheet metal, by being punched or cut out. The spring-elastic valve tongue 72 of the main valve 70 and the spring-elastic valve tongue 62 of the relief valve 60, together with the common fastening region, thus exhibit a constant thickness b over their entire area.

The abutment 73 of the main valve 70 and the abutment 63 of the relief valve 60 are connected in a positive fit to the pump housing 30 via their common fastening region and a fastening element. The fastening element of the example embodiment in FIG. 1 and FIG. 2 is formed by a screw. It will be obvious to the person skilled in the art that the connection can also be established for example via a blind rivet or an adhesive, welded or soldered connection.

The spring-elastic valve tongue 72 of the main valve 70 and the spring-elastic valve tongue 62 of the relief valve 60 are connected to the pump housing 30 via their common fastening region and the same fastening element which already connects the abutment 73 of the main valve 70 and the abutment 63 of the relief valve 60 to the pump housing 30. In a plan view, the abutment 73 of the main valve 70 overlaps the spring-elastic valve tongue 72 of the main valve 70 and the discharge opening 53. Similarly, in a plan view, the abutment 63 of the relief valve 60 overlaps the spring-elastic valve tongue 62 of the relief valve 60 and the relief opening 43. The relief opening 43 is adjacent to the discharge opening 53 in the circumferential direction, wherein the relief opening 43 and the discharge opening 53 are offset with respect to each other in the axial direction.

FIG. 2 shows the example embodiment of FIG. 1 in a plan view onto the relief valve 60 and the main valve 70. As can be seen from FIG. 2, the abutment 73 of the main valve and the abutment 63 of the relief valve are connected to each other in an L shape via a common fastening region. The valve seat 71 of the main valve is formed by the pump housing 30 which surrounds the discharge channel 52, wherein the discharge opening 53 is covered by the valve abutment 73 of the main valve. The abutment 73 of the main valve can comprise a cavity, as can be seen in FIG. 2. The cavity facilitates the spring-elastic pivoting movement of the valve tongue 72 by enabling the air moved by the spring-elastic valve tongue 72 to flow through the cavity in the abutment 73 of the main valve, such that the flow resistance formed by the abutment 73 of the main valve is reduced. Although the abutment 63 of the relief valve does not show such a cavity in FIG. 2, it should be explicitly indicated that such a cavity can also be provided for the abutment 63 of the relief valve. The spring-elastic valve tongue 72 of the main valve is covered by the abutment 73 of the main valve and can only be seen through the cavity in the abutment 73.

Figure 3:
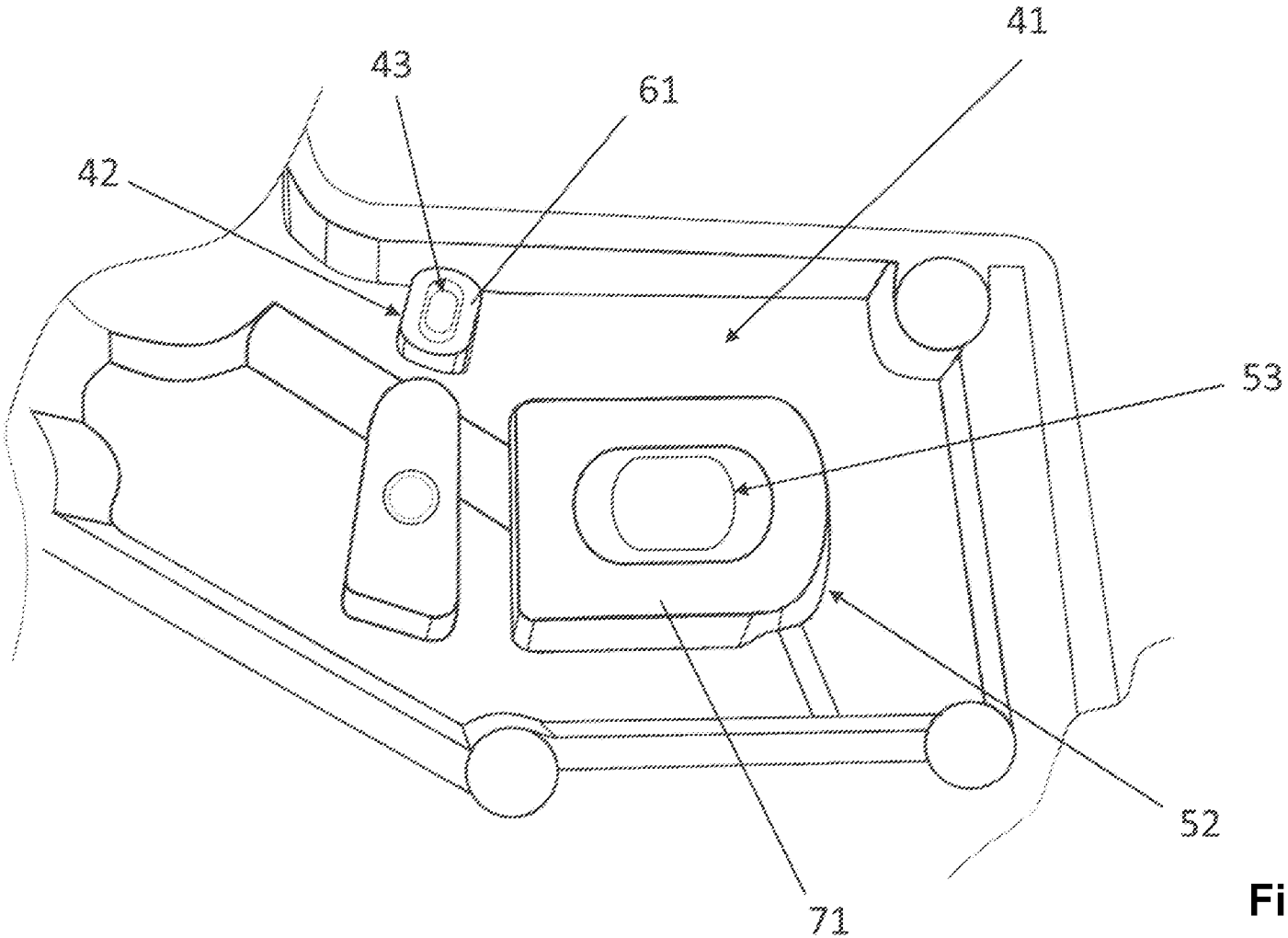
FIG. 3 a plan view onto the relief and discharge opening of the first example embodiment.

FIG. 3 shows the first example embodiment of the vacuum pump in a plan view with the abutment of the main valve, the abutment of the relief valve, the spring-elastic valve tongue 72 of the main valve and the spring-elastic valve tongue 62 of the relief valve disassembled. FIG. 3 shows the valve seat 71 of the main valve and the valve seat 61 of the relief valve in a plan view. The valve seat 71 of the main valve is formed by the pump housing which surrounds the discharge channel 52, and the valve seat 61 of the relief valve is formed by the pump housing which surrounds the relief channel 42. It can be seen from FIG. 3 that the discharge opening 53 is larger than the relief opening 43.

The suction channel 41 is indicated in FIG. 2 and FIG. 3 by an arrow onto the pump housing, i.e. the suction channel 41 itself cannot be seen, but rather only the pump housing 30 which covers it. The relief channel 42 protrudes from the suction channel 41, as can be seen in FIG. 3.

Figure 4:
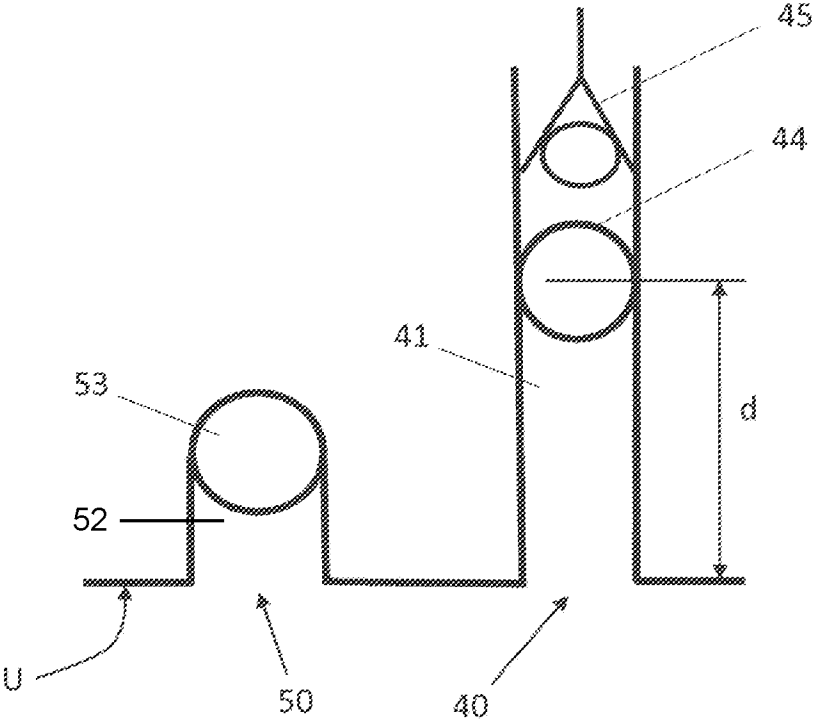
FIG. 4 a schematic representation of the channel intersection of the relief channel.
Figure 5:
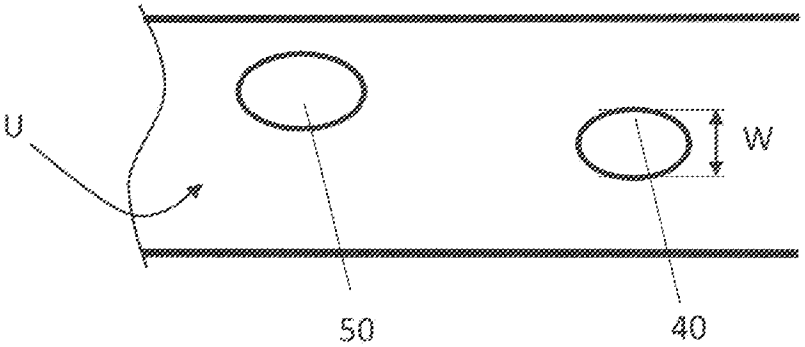
FIG. 5 a schematic representation of the chamber inlet opening and the chamber outlet opening.

FIG. 4 and FIG. 5 each show a schematic view of the suction channel 41, comprising the chamber inlet opening 40 and the channel intersection 44, and the discharge channel 52 comprising the chamber outlet 50 and the discharge opening 53. For greater comprehensibility, the inner circumference of the delivery chamber, i.e. the radial boundary surface U of the delivery chamber, is shown unfurled, such that it then appears as a straight line in the schematic plan view of FIG. 4 and as a belt in a schematic radial view. The chamber inlet opening 40 and the chamber outlet opening 50 are adjacent to each other in the circumferential direction of the radial boundary surface U of the delivery chamber, wherein they are embodied to be offset from each other in an axial view. The latter is in particular production-related and shall not restrict the invention to this effect. The chamber inlet opening 40 and the chamber outlet opening 50 can thus be formed level with each other in the axial view.

The chamber inlet opening 40 exhibits a smaller flow cross-section than the chamber outlet opening 50, wherein the chamber outlet opening 50 extends further than the chamber inlet opening 40 both in the circumferential direction of the radial boundary surface U and in the axial direction. The flow cross-section of the chamber inlet opening 40 and the flow cross-section of the chamber outlet opening 50 are shown to be elliptical in the example embodiment of FIG. 5, but can exhibit any other cross-section, for example a round, rectangular or polygonal cross-section, wherein the smallest width W is understood to mean the extent of the chamber inlet opening 40 which exhibits the smallest diameter. In the present example embodiment of FIG. 5, which shows an elliptical chamber inlet opening 40, the chamber inlet opening does not extend as far in the axial direction as in the circumferential direction of the radial boundary surface U of the delivery chamber.

The suction channel 41 emerges into the delivery chamber via the chamber inlet opening 40. The suction channel 41 extends in the upstream direction, in relation to a flow established when the delivery member 10, 20 rotates in the forward rotational direction, up to a suction port 46, which is no longer shown, via a reflux valve 45. The reflux valve 45 is preferably formed in the region of the suction port 46.

The reflux valve 45 opens the suction channel 41 when the delivery member 10, 20 rotates in the forward rotational direction, such that fluid can flow from the suction port 46 towards the delivery chamber, and prevents fluid from flowing out via the suction port 46 when the delivery member 10, 20 rotates in the reverse rotational direction.

The reflux valve 45 is formed upstream, in relation to a flow established when the delivery member 10, 20 rotates in the forward rotational direction, of the channel intersection 44 at which the relief channel 42 emerges into the suction channel 41. The channel intersection 44 at which the relief channel 42 emerges into the suction channel 41 is formed upstream of the chamber inlet opening 40 in relation to a flow formed when the delivery member 10, 20 rotates in the forward rotational direction.

The channel intersection 44 is spaced from the chamber inlet opening 40 in the upstream direction, in relation to a flow established when the delivery member 10, 20 rotates in the forward rotational direction, by the length d, wherein the length d corresponds to at least the smallest width W of the chamber inlet opening 40. In FIG. 4, the length d is more than four times the smallest width W of the chamber inlet opening 40, wherein the length d by which the channel intersection 44 is spaced from the chamber inlet opening 40 is measured along the suction channel 41 and indicates the distance at which the suction channel 41 emerges into the relief channel 42.

In preferred embodiments, the length d by which the channel intersection 44 is distanced from the chamber inlet opening 40, i.e. the distance from the delivery chamber, is at least as large as the diameter of an equivalent circle whose circular area corresponds to the cross-sectional area of the chamber inlet opening. Where spacing ratios are concerned, the smallest width W is measured on the outline which the chamber inlet opening—in the example, the chamber inlet opening 40—exhibits in the unfurled inner circumferential area and/or in the unfurled radial boundary surface U. Said cross-sectional area of the chamber inlet opening is the area enclosed by this outline.

The relief channel 42 is formed as a divergence from the suction channel 41, i.e. the relief channel 42 is connected to the delivery chamber via the suction channel 41. The relief channel 42 does not however comprise any point of its own at which it emerges into the delivery chamber. This is shown in FIG. 4 by the fact that the radial boundary surface U of the delivery chamber in FIG. 4 is interrupted only by the chamber inlet opening 40 and the chamber outlet opening 50, and in FIG. 5 by the fact that only the chamber inlet opening 40 and the chamber outlet opening 50 can be seen in the radial boundary surface U in FIG. 5.

Figure 6:
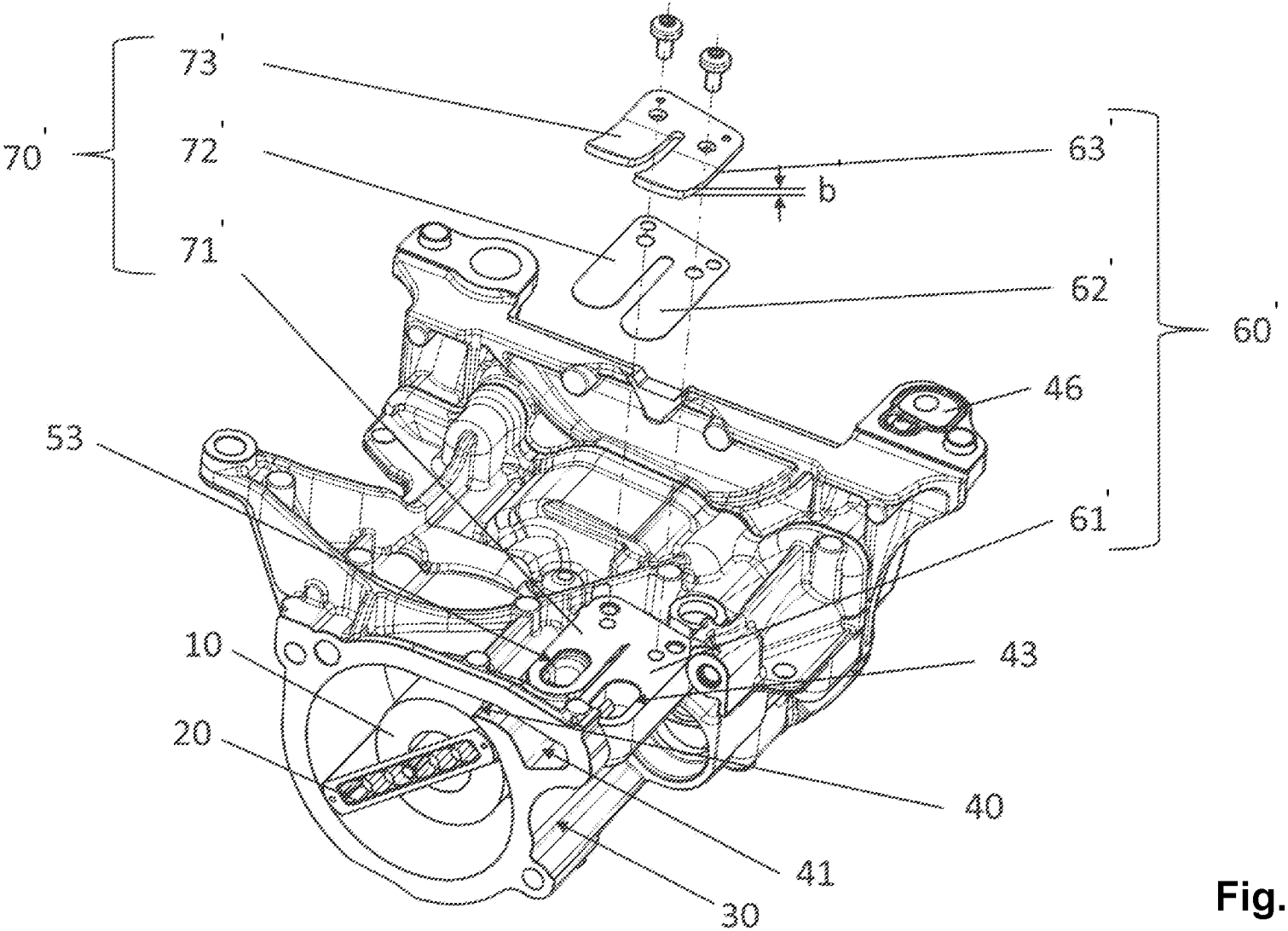
FIG. 6 an isometric view of a second example embodiment of the vacuum pump.

FIG. 6 shows an isometric view of a second example embodiment of the vacuum pump, wherein the relief valve 60 and the main valve 70 are shown in the form of an exploded representation. Except for the main valve 70' and the relief valve 60', the vacuum pump of the second example embodiment substantially corresponds to the vacuum pump of the first example embodiment. Differing components of the second example embodiment, i.e. components which are configured differently from the first example embodiment, are marked with an apostrophe for a better overview.

Since the vacuum pump of the second example embodiment differs from the vacuum pump of the first example embodiment in particular by the relief valve 60' and the main valve 70', these will be discussed in more detail in the following.

The main valve 70' and the relief valve 60' are formed as a double reed valve. The main valve 70' comprises a spring-elastic valve tongue 72' and an abutment 73' for the spring-elastic valve tongue 72'. Similarly, the relief valve 60' comprises a spring-elastic valve tongue 62' and an abutment 63'. The abutment 73' of the main valve 70' and the abutment 63' of the relief valve 60' protrude in a U shape from a common fastening region, i.e. the longitudinal axis of the abutment 73' of the main valve 70' and the longitudinal axis of the abutment 63' of the relief valve 60' extend in parallel from the common fastening region. The abutment 73' of the main valve 70' and the abutment 63' of the relief valve 60' enclose an angle β of 0°, wherein a deviation of at most ±20° is allowable.

The abutment 73' of the main valve 70' and the abutment 63' of the relief valve 60' are formed in one piece with the common fastening region. The abutment 73' of the main valve 70' and the abutment 63' of the relief valve 60' are formed together with the common fastening region from sheet metal, in particular by being punched or cut out, wherein the abutment 73' of the main valve 70', the abutment 63' of the relief valve 60' and the common fastening region exhibit a constant thickness b' over their entire area.

Figure 9:
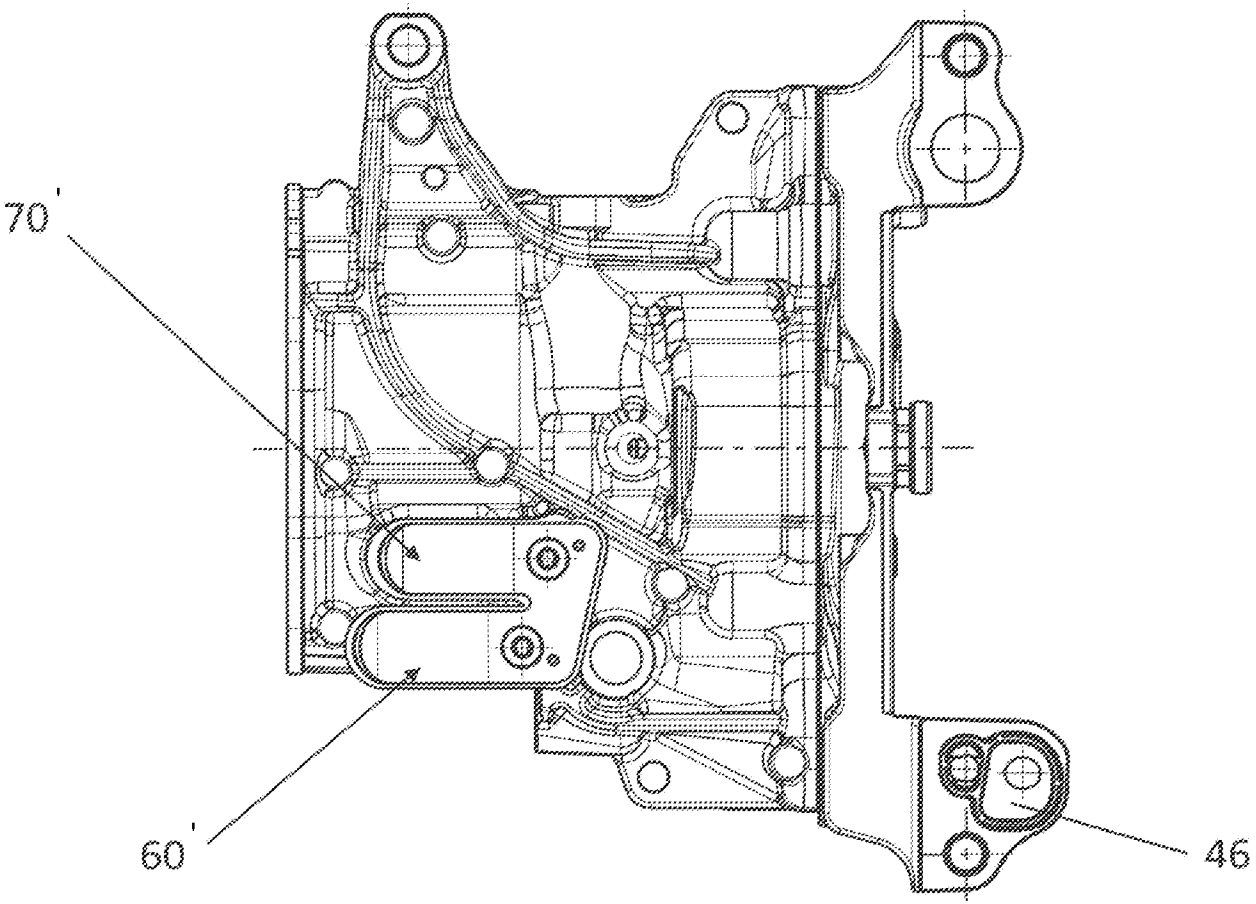
FIG. 9 a plan view onto the relief valve and main valve of the second example embodiment.

In FIG. 9, which shows a plan view onto the vacuum pump of the second example embodiment, it can be seen that the abutment 73' of the main valve 70' and the abutment 63' of the relief valve 60' protrude to exactly the same extent from the common fastening region, wherein the abutment 73' of the main valve 70' and the abutment 63' of the relief valve 60' protrude from the common fastening region with an offset with respect to each other in relation to their longitudinal axis.

Figure 10:
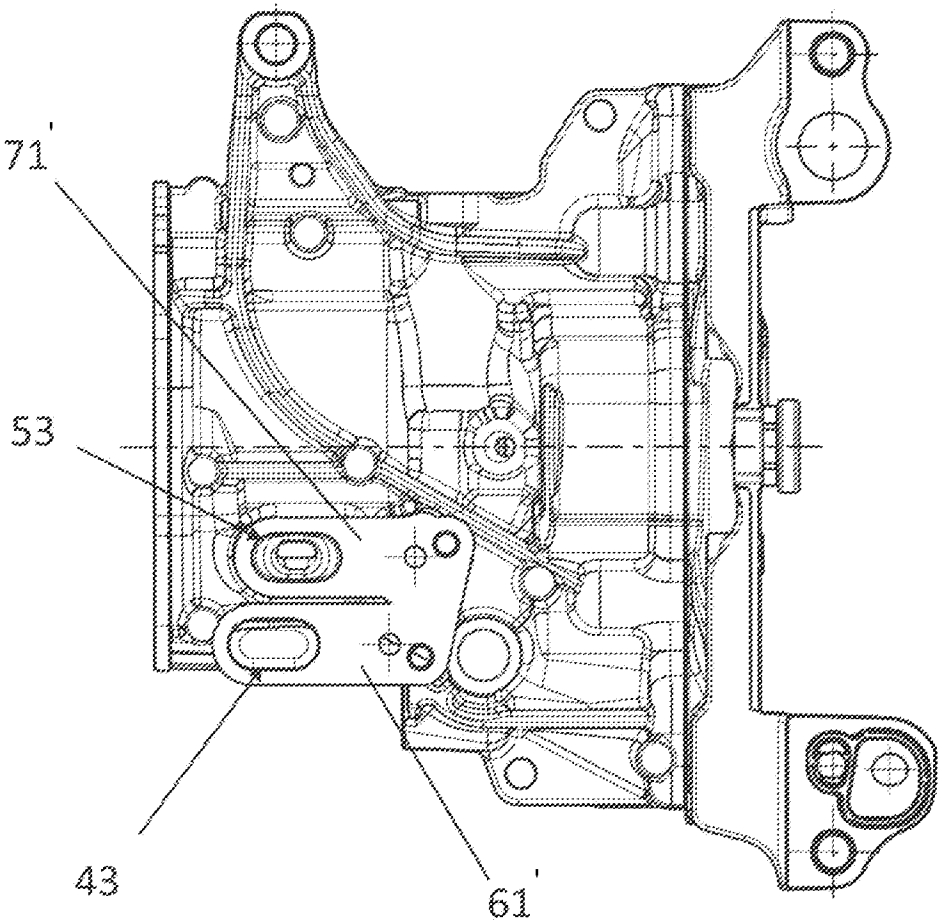
FIG. 10 a plan view onto the relief and discharge opening of the second example embodiment.

This is due to the discharge opening 53 and the relief opening 43 which, as can be seen in FIG. 10, are arranged next to each other in the circumferential direction of the vacuum pump and offset with respect to each other in the axial direction.

The statements just made apply similarly to the spring-elastic valve tongue 72' of the main valve 70' and the spring-elastic valve tongue 62' of the relief valve 60', i.e. the spring-elastic valve tongue 62' of the relief valve 60' and the spring-elastic valve tongue 72' of the main valve 70' protrude from a common fastening region, wherein the spring-elastic valve tongue 62' of the relief valve 60' and the spring-elastic valve tongue 72' of the main valve 70' are produced in one piece with the common fastening region. The spring-elastic valve tongue 62' of the relief valve 60' and the spring-elastic valve tongue 72' of the main valve 70' are connected to each other in a U shape via the common fastening region, i.e. the spring-elastic valve tongue 62' of the relief valve 60' and the spring-elastic valve tongue 72' of the main valve 70' protrude from the common fastening region at an enclosed angle α of 90° with a deviation of at most ±20°.

The spring-elastic valve tongue 72' of the main valve 70' and the spring-elastic valve tongue 62' of the relief valve 60' are formed together with the common fastening region from sheet metal, in particular spring sheet metal, by being punched or cut out. The spring-elastic valve tongue 72' of the main valve 70' and the spring-elastic valve tongue 62' of the relief valve 60', together with the common fastening region, exhibit a constant thickness.

Contrary to the vacuum pump of the first example embodiment, the abutment 73' of the main valve 70' and the abutment 63' of the relief valve 60', together with the spring-elastic valve tongue 72' of the main valve 70' and the spring-elastic valve tongue 62' of the relief valve 60', are connected to the pump housing 30 via their common fastening region by means of two screws.

Figure 7:
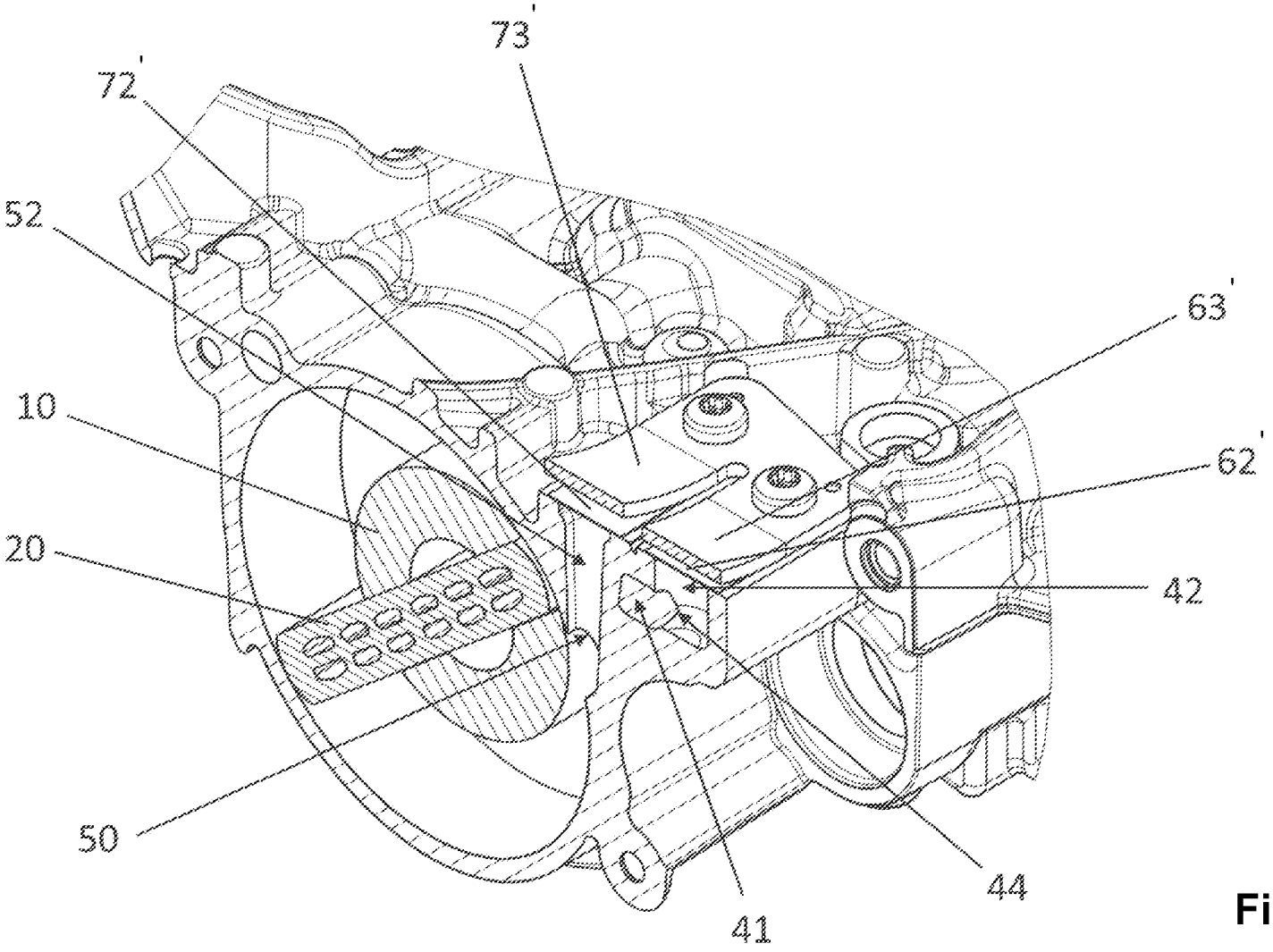
FIG. 7 a section through the isometric view of the second example embodiment.
Figure 8:
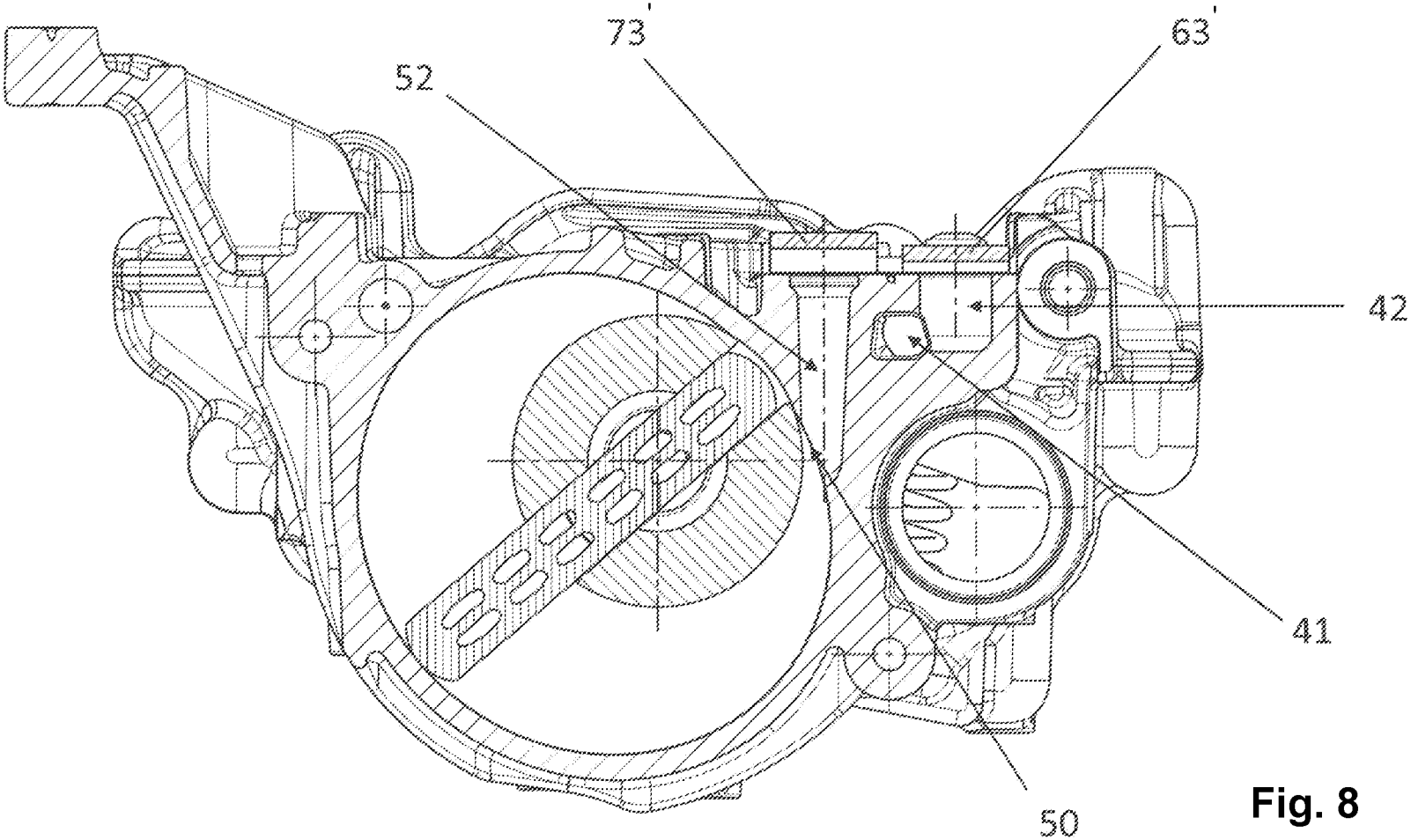
FIG. 8 a section of the vacuum pump of the second example embodiment in a front view.

FIG. 7 and FIG. 8 show a section through the vacuum pump of the second example embodiment, in a plan view and as an isometric view, with the main valve 70' and the relief valve 60' assembled. Together with FIG. 6, the profile of the suction channel 41 and discharge channel 52 can be clearly seen. Even if the profiles of the suction channel 41 and discharge channel 52 in the first example embodiment and second example embodiment do not exactly match, the essential feature of an aspect of the invention remains that the relief channel 42 emerges into the suction channel 41 upstream of the chamber inlet opening 40 when the delivery member 10, 20 rotates in the forward rotational direction. Reference shall therefore be made exclusively to FIGS. 6, 7 and 8 in the following, wherein the statements made also apply to the first example embodiment.

The relief channel 42 is formed as a blind bore in the pump housing 30, which intersects the suction channel 41, wherein the region in which the relief channel 42 intersects the suction channel 41 forms the channel intersection 44. The channel intersection 44 is formed upstream of the chamber inlet opening 40 in relation to a flow formed when the delivery member 10, 20 rotates in the forward rotational direction, such that the relief channel is only connected to the delivery chamber via the suction channel 41. As can be seen in particular from FIG. 8, the blind bore of the relief channel 42 does not completely penetrate the pump housing 30, i.e. the relief channel 42 comprises a channel base, wherein the channel base can also be formed by a boundary of the suction channel 41.

LIST OF REFERENCE SIGNS

10 rotor
20 rotor vane
30 housing
40 chamber inlet opening
41 suction channel
42 relief channel
43 relief opening
44 canal intersection
45 reflux valve
46 suction port
50 chamber outlet opening
52 discharge channel
53 discharge opening
60 relief valve
60' relief valve
61 valve seat
61' valve seat
62 valve tongue
62' valve tongue
63 abutment
63' abutment
70 main valve
70' main valve
71 valve seat
71' valve seat
72 valve tongue
72' valve tongue
73 abutment
73' abutment
b thickness
b' thickness
d length of the suction channel
U boundary surface of the delivery chamber
W width of the channel inlet opening

The invention claimed is:

1. A vacuum pump for supplying a machine assembly with negative pressure, the vacuum pump comprising:

1.1 a housing featuring:

1.1.1 a delivery chamber which comprises a chamber inlet opening and a chamber outlet opening for a gaseous fluid;

1.1.2 a suction port for establishing a fluid connection to the machine assembly;

1.1.3 a suction channel which emerges into the delivery chamber via the chamber inlet opening and connects the delivery chamber to the suction port; and 1.1.4 a relief channel which connects the delivery chamber to a relief opening of the housing;

1.1.5 a discharge opening connected to the chamber outlet opening;

1.2 a delivery member which can rotate in the delivery chamber in a forward rotational direction and a reverse rotational direction, wherein the fluid is suctioned into the delivery chamber through the chamber inlet opening and discharged through the chamber outlet opening by rotating the delivery member in the forward rotational direction; and 1.3 a relief valve for closing the relief opening when the delivery member rotates in the forward rotational direction and opening the relief opening when the delivery member rotates in the reverse rotational direction, 1.4 a main valve in order to prevent the fluid from being suctioned through the discharge opening when the delivery member rotates in the reverse rotational direction and to allow the fluid to be discharged through the discharge opening when the delivery member rotates in the forward rotational direction, 1.5 wherein the relief channel emerges into the suction channel, and 1.6 wherein the relief valve and the main valve are each formed as a reed valve comprising a spring-elastic valve tongue and an abutment for the valve tongue, 1.7 wherein the valve tongue of the relief valve and the valve tongue of the main valve are connected to each other via a common fastening region, 1.8 wherein the valve tongues are connected in an L shape via the common fastening region and are produced in one piece, and protrude, as viewed in a plan view, from the common fastening region at an enclosed angle $\alpha$, 1.9 wherein $\alpha$ is 90° with a deviation at most of ±20°, and 1.10 wherein the relief valve and the main valve together form a double reed valve, and 1.11 wherein the valve tongue of the main valve, as viewed in a plan view, is wider than the valve tongue of the relief valve.

2. The vacuum pump according to claim 1, wherein the relief channel emerges into the suction channel at a distance from the chamber inlet opening by a length measured along the suction channel.

3. The vacuum pump according to claim 1, wherein the suction channel exhibits a length from the chamber inlet opening to a channel intersection at which the relief channel emerges into the suction channel which is at least as large as a smallest width of the chamber inlet opening.

4. The vacuum pump according to claim 1, wherein the relief opening and a channel intersection at which the relief channel emerges into the suction channel are equal in size.

5. The vacuum pump according to claim 1, wherein the abutment of the relief valve and the abutment of the main valve are connected to each other via a common fastening region.

6. The vacuum pump according to claim 5, wherein the abutments are connected to each other in an L shape via the common fastening region.

7. The vacuum pump according to claim 1, wherein the abutment of the relief valve and the abutment of the main valve are produced in one piece and protrude, as viewed in a plan view, from a common fastening region at an enclosed angle β, wherein β<180° .

8. The vacuum pump according to claim 7, wherein β>40°.

9. The vacuum pump according to claim 8, wherein β is 90° with a deviation of at most ±20°.

10. The vacuum pump according to claim 7, wherein β>60°.

11. The vacuum pump according to claim 1, wherein the discharge opening is connected to the chamber outlet opening via a discharge channel.

12. The vacuum pump according to claim 11, wherein the mean flow cross-section of the relief channel and the mean flow cross-section of the discharge channel differ from each other.

13. The vacuum pump according to claim 1, wherein a reflux valve separates the suction channel from the machine assembly when the delivery member rotates in the reverse rotational direction.

14. The vacuum pump according to claim 1, wherein the vacuum pump is a vane cell pump.

15. The vacuum pump according to claim 1, wherein the abutment of the relief valve and the abutment of the main valve are produced in one piece and protrude, as viewed in a plan view, from a common fastening region at an enclosed angle β, wherein β<150°.

16. The vacuum pump according to claim 1, wherein the abutment of the relief valve and the abutment of the main valve are produced in one piece and protrude, as viewed in a plan view, from a common fastening region at an enclosed angle β, wherein β<120°.

* * * * *